US009734814B2

(12) United States Patent
Christoph et al.

(10) Patent No.: US 9,734,814 B2
(45) Date of Patent: Aug. 15, 2017

(54) ACTIVE NOISE REDUCTION

(71) Applicant: Harman Becker Automotive Systems GmbH, Karlsbad (DE)

(72) Inventors: Markus Christoph, Straubing (DE); Johann Freundorfer, Bogen (DE); Thomas Hommel, Rain (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 14/671,632

(22) Filed: Mar. 27, 2015

(65) Prior Publication Data

US 2015/0201277 A1 Jul. 16, 2015

Related U.S. Application Data

(63) Continuation of application No. 13/656,274, filed on Oct. 19, 2012, now Pat. No. 9,099,076.

(30) Foreign Application Priority Data

Oct. 21, 2011 (EP) ..... 11186155

(51) Int. Cl.
*G10K 11/178* (2006.01)
*H04R 3/00* (2006.01)

(52) U.S. Cl.
CPC ..... *G10K 11/178* (2013.01); *H04R 3/002* (2013.01); *G10K 2210/1081* (2013.01); *G10K 2210/3028* (2013.01); *H04R 2410/05* (2013.01)

(58) Field of Classification Search
None
See application file for complete search history.

(56) References Cited

U.S. PATENT DOCUMENTS

| | | | | |
|---|---|---|---|---|
| 4,801,890 | A | 1/1989 | Dolby | |
| 2006/0188104 | A1 | 8/2006 | De Poortere | |
| 2009/0123003 | A1* | 5/2009 | Sibbald | G10K 11/178 381/71.14 |
| 2010/0014685 | A1* | 1/2010 | Wurm | G10K 11/178 381/71.11 |
| 2010/0142718 | A1 | 6/2010 | Chin et al. | |
| 2010/0272283 | A1 | 10/2010 | Carreras et al. | |

(Continued)

FOREIGN PATENT DOCUMENTS

| | | |
|---|---|---|
| EP | 1921603 A2 | 5/2008 |
| JP | 54110762 | 8/1979 |

(Continued)

OTHER PUBLICATIONS

Hansen et al., "Active Control of Noise and Vibration", pp. 642-658, E&FN Spon. 1997.
Kataja et al., "Optimisation of digitally adjustable analogue biquad filters in feedback active control", Forum Acusticum, 2005.
Nelder et al., "A simplex method for function minimization", The Computer Journal,. 1965.

(Continued)

*Primary Examiner* — Paul Huber
(74) *Attorney, Agent, or Firm* — Brooks Kushman P.C.

(57) ABSTRACT

A noise reducing sound reproduction system comprises a loudspeaker that is connected to a loudspeaker input path and that radiates noise reducing sound. A microphone is connected to a microphone output path and picks up the noise or a residual thereof. An active noise reduction filter is connected between the microphone output path and the loudspeaker input path, and the active noise reduction filter comprises at least one shelving filter.

16 Claims, 8 Drawing Sheets

(56) References Cited

U.S. PATENT DOCUMENTS

| | | | | |
|---|---|---|---|---|
| 2011/0007907 | A1* | 1/2011 | Park | G10K 11/178 381/71.8 |
| 2011/0142247 | A1* | 6/2011 | Fellers | G10K 11/178 381/71.1 |
| 2011/0211707 | A1 | 9/2011 | Fuller | |
| 2011/0235693 | A1* | 9/2011 | Lee | H04S 7/00 375/224 |
| 2011/0293103 | A1 | 12/2011 | Park et al. | |
| 2012/0316872 | A1* | 12/2012 | Stoltz | G10L 21/0216 704/233 |

FOREIGN PATENT DOCUMENTS

| | | | |
|---|---|---|---|
| JP | 58040935 | | 3/1983 |
| JP | H03150945 | A | 6/1991 |
| JP | 03274895 | | 12/1991 |
| JP | H05504451 | A | 7/1993 |
| JP | 11305784 | | 11/1999 |
| JP | 2005257720 | A | 9/2005 |
| JP | 2007500466 | A | 1/2007 |
| JP | 2008268257 | A | 11/2008 |

OTHER PUBLICATIONS

Nelson et al., "Active Control of Sound", Academic Press 1992, United States Edition published by Academic Press Inc., San Diego, CA 92101, ISBN 0-12-515425-9.

S.J. Elliott, "Signal Processing and its Applications", Academic Press 2001, ISBN 0-12-237085-6.

Holters et al., "Parametric Higher-Order Shelving Filters", EUSIPCO 2006, Florence, Italy, Sep. 4-8, 2006, 4 pages.

Linkwitz, "Active Filters", Linkwitz Lab, Sensible Reproduction and Recording of Auditory Scenes, Jul. 13, 2011, 11 pages.

European Search Report for Application No. 12168685.1, mailed Sep. 14,2012, 6 pages.

Japanese Office Action for Application No. 2014-164679, mailed May 31, 2016, 4 pages.

U.S. Office Action for U.S. Appl. No. 13/899,073, mailed Jan. 4, 2016, 13 pages.

U.S. Office Action for U.S. Appl. No. 13/899,073, mailed Sep. 4, 2015, 20 pages.

English translation of Japanese Office Action for Application No. 2012-232034, dated Sep. 27, 2013, 3 pages.

* cited by examiner

ACTIVE NOISE REDUCTION

CLAIM OF PRIORITY

This patent application is a continuation of U.S. patent application Ser. No. 13/656,274 filed on Oct.19, 2012, which claims priority from EP Application No. 11 186 155.5 filed Oct. 21, 2011, which is hereby incorporated by reference.

FIELD OF TECHNOLOGY

Disclosed herein is an active noise reduction system and, in particular, a noise reduction system which includes an earphone for allowing a user to enjoy, for example, reproduced music or the like, with reduced ambient noise.

RELATED ART

An active noise reduction system, also known as active noise cancellation/control (ANC) system, uses a microphone to pick up an acoustic error signal (also called a "residual" signal) after the noise reduction, and feeds this error signal back to an ANC filter. This type of ANC system is called a feedback ANC system. The filter in a feedback ANC system is typically configured to reverse the phase of the error feedback signal and may also be configured to integrate the error feedback signal, equalize the frequency response, and/or to match or minimize the delay. Thus, the quality of a feedback ANC system heavily depends on the quality of the ANC filter.

When used in mobile devices such as headphones, the space and energy available for the ANC filter is quite limited. Digital circuitry may be too space and energy consuming, so that in mobile devices analog circuitry is often the preferred ANC filter design. However, analog circuitry allows only for a very limited complexity of the ANC system and thus it is hard to correctly model the secondary path solely by an analog system. In particular, analog filters used in an ANC system are often fixed filters or relatively simple adaptive filters because they are easy to build, have low energy consumption and require little space. The same problem arises with ANC systems having a feedforward or other suitable noise reducing structure. A feedforward ANC system uses an ANC filter to generate a signal (secondary noise) that is equal to a disturbance signal (primary noise) in amplitude and frequency, but has opposite phase. There is a general need for analog ANC filters of, e.g., feedforward or feedback ANC systems that are less space and energy consuming, but have an improved performance.

SUMMARY OF THE INVENTION

A noise reducing sound reproduction system comprises a loudspeaker that is connected to a loudspeaker input path and that radiates noise reducing sound; a microphone that is connected to a microphone output path and that senses the noise or a residual thereof; and an active noise reduction filter that is connected between the microphone output path and the loudspeaker input path; the active noise reduction filter comprising at least one shelving filter.

These and other objects, features and advantages of the present invention will become apparent in light of the detailed description of the embodiments thereof, as illustrated in the accompanying drawings. In the figures, like reference numerals designate corresponding parts.

DESCRIPTION OF THE DRAWINGS

Various specific embodiments are described in more detail below based on the exemplary embodiments shown in the figures of the drawing. Unless stated otherwise, similar or identical components are labeled in all of the figures with the same reference numbers.

DETAILED DESCRIPTION OF THE INVENTION

Feedback ANC systems reduce or even cancel a disturbing signal, such as noise, by providing a noise reducing signal that ideally has the same amplitude over time but the opposite phase compared to the noise signal. By superimposing the noise signal and the noise reducing signal, the resulting signal, also known as error signal, ideally tends toward zero. The quality of the noise reduction depends on the quality of a so-called secondary path, i.e., the acoustic path between a loudspeaker and a microphone representing the listener's ear. The quality of the noise reduction also depends on the quality of a so-called ANC filter that is connected between the microphone and the loudspeaker and that filters the error signal provided by the microphone such that, when the filtered error signal is reproduced by the loudspeaker, it further reduces the error signal. However, problems occur when in addition to the filtered error signal a useful signal such as music or speech is provided at the listening site, in particular by the loudspeaker that also reproduces the filtered error signal. Then the useful signal may be deteriorated by the system as previously mentioned.

For the sake of simplicity, no distinction is made herein between electrical and acoustic signals. However, all signals provided by the loudspeaker or received by the microphone are actually of an acoustic nature. All other signals are electrical in nature. The loudspeaker and the microphone may be part of an acoustic sub-system (e.g., a loudspeaker-room-microphone system) having an input stage formed by the loudspeaker and an output stage formed by the microphone; the sub-system being supplied with an electrical input signal and providing an electrical output signal. "Path" means in this regard an electrical or acoustical connection that may include further elements such as signal conducting means, amplifiers, filters, etc. A spectrum shaping filter is a filter in which the spectra of the input and output signal are different over frequency.

Figure 1:
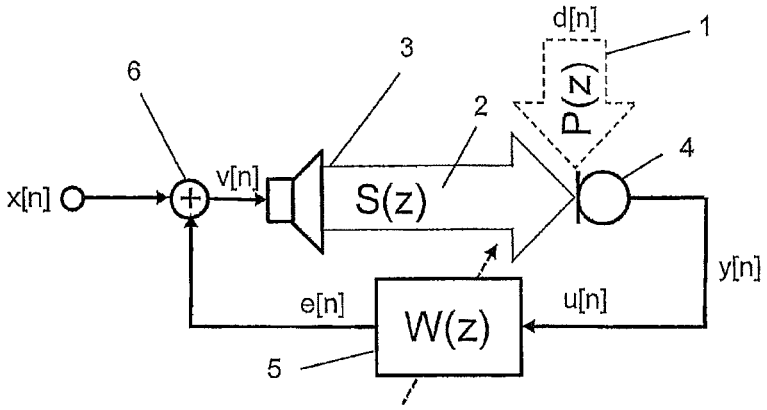
FIG. 1 is a block diagram of a general feedback type active noise reduction system in which the useful signal is supplied to the loudspeaker signal path.

FIG. 1 is a block diagram illustration of a feedback type active noise reduction (ANC) system in which a disturbing signal d[n], also referred to as noise signal, is transferred (radiated) to a listening site, e.g., a listener's ear, via a primary path 1. The primary path 1 has a transfer characteristic of P(z). Additionally, an input signal v[n] is transferred (radiated) from a loudspeaker 3 to the listening site via a secondary path 2. The secondary path 2 has a transfer characteristic of S(z).

A microphone 4 is positioned to receive audio at the listening site, which includes the disturbing signal d[n] and the audio radiated by the loudspeaker 3. The microphone 4 provides a microphone output signal y[n] that represents the sum of these received signals. The microphone output signal y[n] is supplied as filter input signal u[n] to an ANC filter 5 that outputs an error signal e[n] to a summer 6. The ANC filter 5, which may be an adaptive filter, has a transfer characteristic of W(z). The summer 6 also receives the useful signal x[n] such as music or speech and provides an input signal v[n] to the loudspeaker 3. The useful signal x[n] may be optionally pre-filtered, e.g., with a spectrum shaping filter (not shown in the drawings).

The signals x[n], y[n], e[n], u[n] and v[n] are in the discrete time domain. For the following considerations their spectral representations X(z), Y(z), E(z), U(z) and V(z) are used. The differential equations describing the system illustrated in FIG. 1 are as follows:

$$Y(z)=S(z)\cdot V(z)=S(z)\cdot(E(z)+X(z))$$

$$E(z)=W(z)\cdot U(z)=W(z)\cdot Y(z)$$

In the system of FIG. 1, the useful signal transfer characteristic M(z)=Y(z)/X(z) is thus $$M(z)=S(z)/(1-W(z)\cdot S(z))$$

Assuming W(z)=1 then $$\lim[S(z)\rightarrow 1]M(z)\Rightarrow M(z)\rightarrow\infty$$

$$\lim[S(z)\rightarrow\pm\infty]M(z)\Rightarrow M(z)\rightarrow 1$$

$$\lim[S(z)\rightarrow 0]M(z)\Rightarrow M(z)\rightarrow S(z)$$

Assuming W(z)=∞then $$\lim[S(z)\rightarrow 1]M(z)\Rightarrow M(z)\rightarrow 0.$$

As can be seen from the above equations, the useful signal transfer characteristic M(z) approaches 0 when the transfer characteristic W(z) of the ANC filter 5 increases, while the secondary path transfer function S(z) remains neutral, i.e., at levels around 1, i.e., 0[dB]. For this reason, the useful signal x[n] has to be adapted accordingly to ensure that the useful signal x[n] is apprehended identically by a listener when ANC is on or off. Furthermore, the useful signal transfer characteristic M(z) also depends on the transfer characteristic S(z) of the secondary path 2, to the effect that the adaption of the useful signal x[n] also depends on the transfer characteristic S(z) and its fluctuations due to aging, temperature, change of listener etc., so that a certain difference between "on" and "off" will be apparent.

Figure 2:
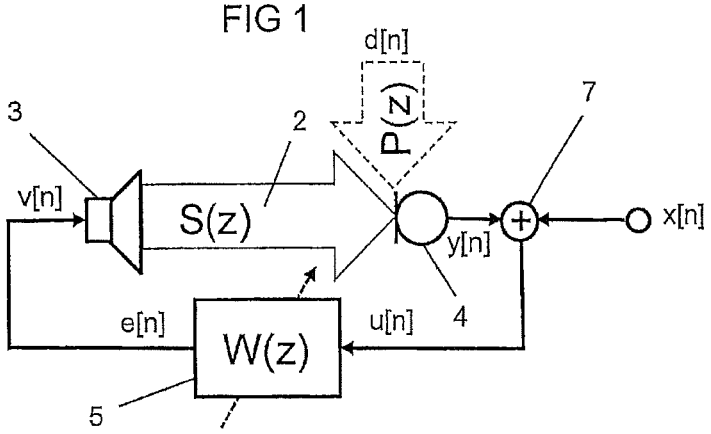
FIG. 2 is a block diagram of a general feedback type active noise reduction system in which the useful signal is supplied to the microphone signal path.

While in the system of FIG. 1 the useful signal x[n] is supplied to the acoustic sub-system (loudspeaker, room, microphone) at the adder 6 connected upstream of the loudspeaker 3, in the system of FIG. 2 the useful signal x[n] is supplied at the microphone 4. Therefore, in the system of FIG. 2, the adder 6 is omitted and an adder 7 is arranged downstream of the microphone 4 to sum the, e.g., pre-filtered, useful signal x[n] and the microphone output signal y[n]. Accordingly, the loudspeaker input signal v[n] is the error signal [e], i.e., v[n]=[e], and the filter input signal u[n] is the sum of the useful signal x[n] and the microphone output signal y[n], i.e., u[n]=x[n]+y[n].

The differential equations describing the system illustrated in FIG. 2 are as follows:

$$Y(z)=S(z)\cdot V(z)=S(z)\cdot E(z)$$

$$E(z)=W(z)\cdot U(z)=W(z)\cdot(X(z)+Y(z))$$

The useful signal transfer characteristic M(z) in the system of FIG. 2 without considering the disturbing signal d[n] is thus $$M(z)=(W(z)\cdot S(z))/(1-W(z))\cdot S(z))$$

$$\lim[(W(z)\cdot S(z))\rightarrow 1]M(z)\Rightarrow M(z)\rightarrow\infty$$

$$\lim[(W(z)\cdot S(z))\rightarrow 0]M(z)\Rightarrow M(z)\rightarrow 0$$

$$\lim[(W(z)\cdot S(z))\rightarrow\pm\infty]M(z)\Rightarrow M(z)\rightarrow 1.$$

As can be seen from the above equations, the useful signal transfer characteristic M(z) approaches 1 when the open loop transfer characteristic (W(z)·S(z)) increases or decreases and approaches 0 when the open loop transfer characteristic (W(z)·S(z)) approaches 0. For this reason, the useful signal x[n] has to be adapted additionally in higher spectral ranges to ensure that the useful signal x[n] is apprehended identically by a listener when ANC is on or off. Compensation in higher spectral ranges is, however, quite difficult so that a certain difference between "on" and "off" will be apparent. On the other hand, the useful signal transfer characteristic M(z) does not depend on the transfer characteristic S(z) of the secondary path 2 and its fluctuations due to aging, temperature, change of listener etc.

Figure 3:
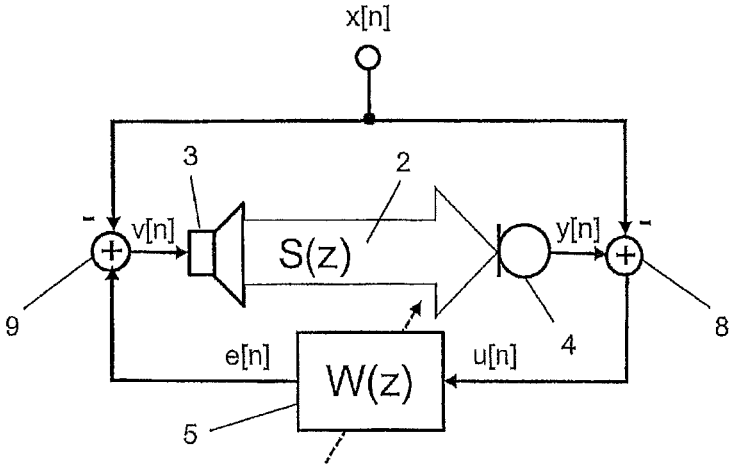
FIG. 3 is a block diagram of a general feedback type active noise reduction system in which the useful signal is supplied to both the loudspeaker and microphone signal paths.

FIG. 3 is a block diagram illustrating a general feedback type active noise reduction system in which the useful signal is supplied to both the loudspeaker path and the microphone path. For the sake of simplicity, the primary path 1 is omitted below notwithstanding that noise (disturbing signal d[n]) is still present. In particular, the system of FIG. 3 is based on the system of FIG. 1, however, with an additional subtractor 8 that subtracts the useful signal x[n] from the microphone output signal y[n] to form the ANC filter input signal u[n], and a subtractor 9 that substitutes the adder 6 and subtracts the useful signal x[n] from the error signal e[n].

The differential equations describing the system illustrated in FIG. 3 are as follows:

$$Y(z)=S(z)\cdot V(z)=S(z)\cdot(E(z)-X(z))$$

$$E(z)=W(z)\cdot U(z)=W(z)\cdot(Y(z)-X(z))$$

The useful signal transfer characteristic M(z) in the system of FIG. 3 is thus $$M(z)=(S(z)-W(z)\cdot S(z))/(1-W(z)\cdot S(z))$$

$$\lim[(W(z)\cdot S(z))\rightarrow 1]M(z)\Rightarrow M(z)\rightarrow\infty$$

$$\lim[(W(z)\cdot S(z))\rightarrow 0]M(z)\Rightarrow M(z)\rightarrow S(z)$$

$$\lim[(W(z)\cdot S(z))\rightarrow\pm\infty]M(z)\Rightarrow M(z)\rightarrow 1.$$

It can be seen from the above equations that the behavior of the system of FIG. 3 is similar to that of the system of FIG. 2. The only difference is that the useful signal transfer characteristic M(z) approaches S(z) when the open loop transfer characteristic (W(z)·S(z)) approaches 0. Like the system of FIG. 1, the system of FIG. 3 depends on the transfer characteristic S(z) of the secondary path 2 and its fluctuations due to aging, temperature, change of listener, etc.

Figure 4:
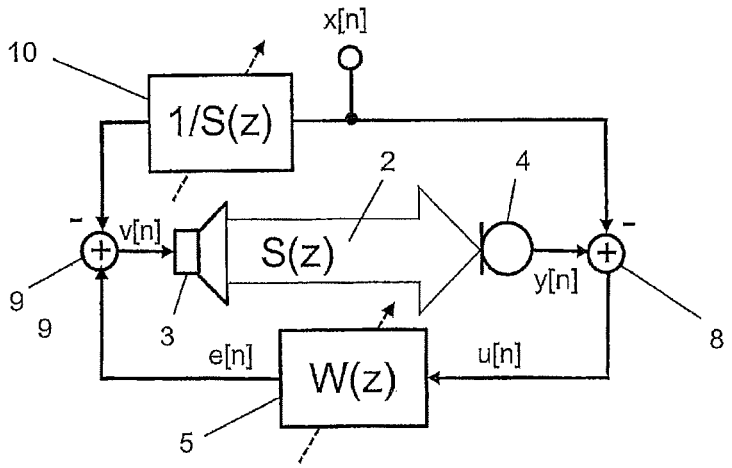
FIG. 4 is a block diagram of the active noise reduction system of FIG. 3, in which the useful signal x[n] is supplied via a spectrum shaping filter to the loudspeaker path.

In FIG. 4, a system is shown that is based on the system of FIG. 3 and that additionally includes an equalizing filter 10 connected upstream of the subtractor 9 in order to filter the useful signal x[n] with the inverse secondary path transfer function 1/S(z). The differential equations describing the system illustrated in FIG. 4 are as follows:

$$Y(z)=S(z)\cdot V(z)=S(z)\cdot(E(z)-X(z)/S(z))$$

$$E(z)=W(z)\cdot U(z)=W(z)\cdot(Y(z)-X(z))$$

The useful signal transfer characteristic M(z) in the system of FIG. 4 is thus $$M(z)=(1-W(z)\cdot S(z))/(1-W(z)\cdot S(z))=1$$

As can be seen from the above equation, the microphone output signal y[n] is identical to the useful signal x[n], which means that signal x[n] is not altered by the system if the equalizer filter is exactly the inverse of the secondary path transfer characteristic S(z). The equalizer filter 10 may be a minimum-phase filter for best results, i.e., for an optimum approximation of its actual transfer characteristic to the inverse of, the ideally minimum phase, secondary path transfer characteristic S(z) and, thus y[n]=x[n]. This configuration acts as an ideal linearizer, i.e., it compensates for any deteriorations of the useful signal resulting from its transfer from the loudspeaker 3 to the microphone 4 representing the listener's ear. Thus it compensates for, or linearizes, the disturbing influence of the secondary path S(z) to the useful signal x[n], such that the useful signal arrives at the listener as provided by the source, without any negative effect caused by acoustical properties of the headphone, i.e., y[z]=x[z]. As such, with the help of such a linearizing filter it is possible to make a poorly designed headphone sound like an acoustically perfectly adjusted, i.e., linear one.

Figure 5:
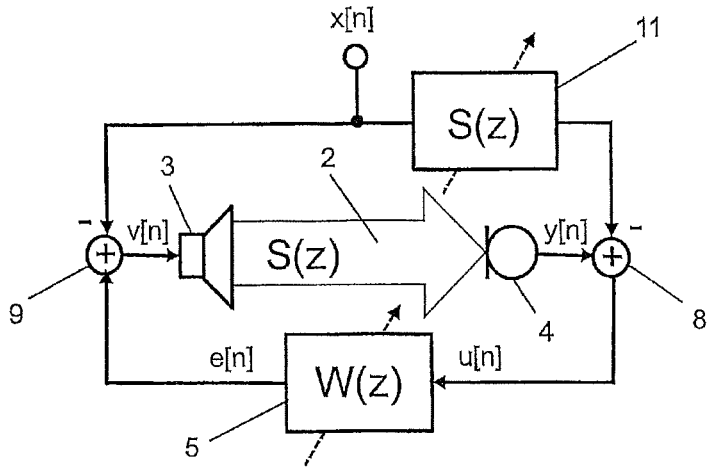
FIG. 5 is a block diagram of the active noise reduction system of FIG. 3, in which the useful signal is supplied via a spectrum shaping filter to the microphone path.

In FIG. 5, a system is shown that is based on the system of FIG. 3 and that additionally includes an equalizing filter 10 connected upstream of the subtractor 8 in order to filter the useful signal x[n] with the secondary path transfer function S(z).

The differential equations describing the system illustrated in FIG. 5 are as follows:

$$Y(z)=S(z)\cdot V(z)=S(z)-(E(z)-X(z))$$

$$E(z)=W(z)\cdot U(z)=W(z)\cdot(Y(z)-S(z)\cdot X(z))$$

The useful signal transfer characteristic M(z) in the system of FIG. 5 is thus $$M(z)=S(z)\cdot(1+W(z)\cdot S(z))/(1+W(z)\cdot S(z))=S(z)$$

From the above equation it can be seen that the useful signal transfer characteristic M(z) is identical with the secondary path transfer characteristic S(Z) when the ANC system is active. When the ANC system is not active, the useful signal transfer characteristic M(z) is also identical with the secondary path transfer characteristic S(Z). Thus, the aural impression of the useful signal for a listener at a location close to the microphone 4 is the same regardless of whether noise reduction is active or not.

The ANC filter 5 and the equalizing filters 10 and 11 may be fixed filters with constant transfer characteristics or adaptive filters with controllable transfer characteristics. In the drawings, the adaptive structure of a filter per se is indicated by an arrow underlying the respective block and the optionality of the adaptive structure is indicated by a broken line.

The system shown in FIG. 5 is, for example, applicable in headphones in which useful signals, such as music or speech, are reproduced under different conditions in terms of noise and the listener may appreciate being able to switch off the ANC system, in particular when no noise is present, without experiencing any audible difference between the active and non-active state of the ANC system. However, the systems presented herein are not applicable in headphones only, but also in all other fields in which occasional noise reduction is desired.

In the ANC systems shown in FIGS. 1-5, feedback structures are employed, however, feedforward structures, equalizing structures, hybrid structures etc. may be used as well.

Figure 6:
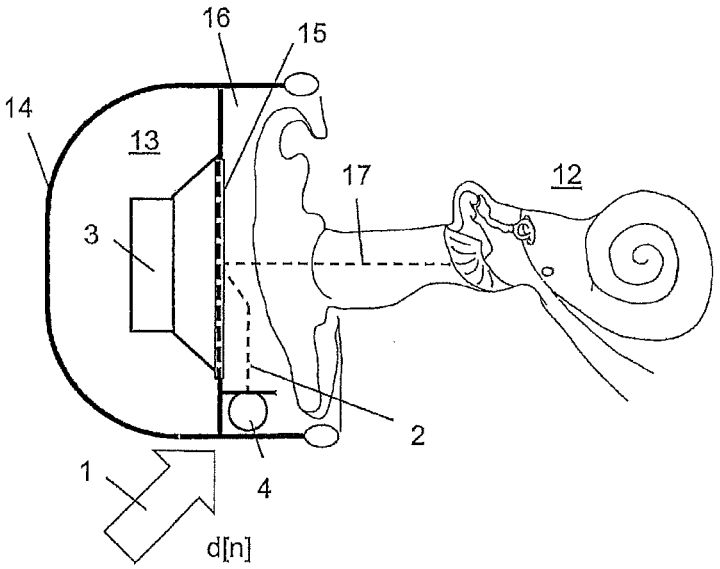
FIG. 6 is a schematic diagram of an earphone applicable in connection with the active noise reduction systems of FIGS. 3-6.

FIG. 6 an exemplary earphone with which the present active noise reduction systems may be used. The earphone may be, together with another identical earphone, part of a headphone (not shown) and may be acoustically coupled to a listener's ear 12. In the present example, the ear 12 is exposed via the primary path 1 to the disturbing signal d[n], (e.g., ambient noise). The earphone comprises a cup-like housing 14 with an aperture 15 that may be covered by a sound permeable cover, e.g., a grill, a grid or any other sound permeable structure or material. The loudspeaker 3 radiates sound to the ear 12 and is arranged at the aperture 15 of the housing 14, both forming an earphone cavity 13. The cavity 13 may be airtight or vented, e.g., a port, vent, opening, etc. The microphone 4 is positioned in front of the loudspeaker 3. An acoustic path 17 extends from the speaker 3 to the ear 12 and has a transfer characteristic which is approximated for noise control purposes by the transfer characteristic of the secondary path 2 which extends from the loudspeaker 3 to the microphone 4.

The systems illustrated above with reference to FIGS. 4 and 5 provide good results when employing analog circuitry as there is a minor (FIG. 4) or even no (FIG. 5) dependency on the secondary path behavior. Furthermore, the systems of FIG. 5 allow for a good estimation of the necessary transfer characteristic of the equalization filter based on the ANC filter transfer characteristic W(z), as well as on the secondary path filter characteristic S(z), both forming the open loop transfer characteristic. W(z)·S(z), which, in principal, has only minor fluctuations, and based on the assessment of the acoustic properties of the headphone when attached to a listener's head.

The ANC filter 5 will usually have a transfer characteristic that tends to have lower gain at lower frequencies with an increasing gain over frequency to a maximum gain followed by a decrease of gain over frequency down to loop gain. With high gain of the ANC filter 5, the loop inherent in the ANC system keeps the system linear in a frequency range of, e.g., below 1 kHz and thus renders any equalization redundant. In the frequency range above 3 kHz, a common ANC filter that may be used as the filter 5 has almost no boosting or cutting effects and, accordingly, no linearization effects. As the ANC filter gain in this frequency range is approximately loop gain, the useful signal transfer characteristic M(z) experiences a boost at higher frequencies that has to be compensated for by a respective filter, which is according to an aspect of the present invention a shelving filter, optionally, in connection with an additional equalizing filter. In the frequency range between 1 kHz and 3 kHz both, boosts and cuts, may occur. In terms of aural impression, boosts are more disturbing than cuts and thus it may be sufficient to compensate for boosts in the transfer characteristic with correspondingly designed cut filters.

Figure 7:
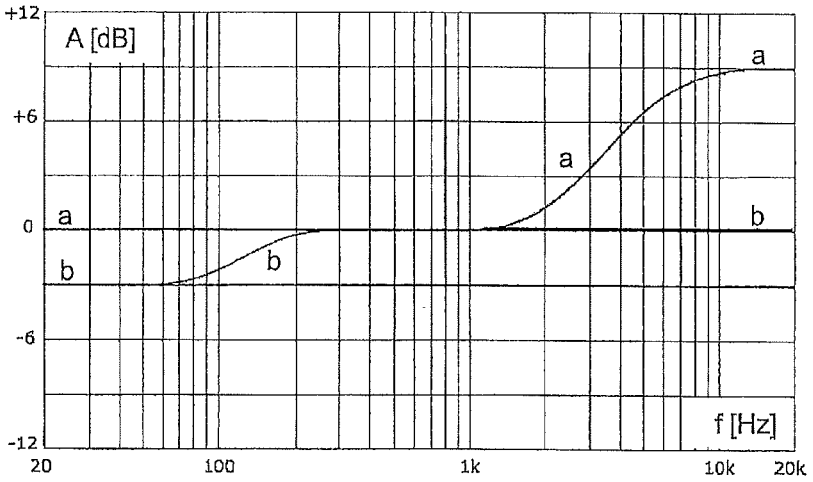
FIG. 7 is a magnitude frequency response diagram representing the transfer characteristics of shelving filters applicable in the systems of FIGS. 1-6.

FIG. 7 is a schematic diagram of the transfer characteristics a, b of shelving filters applicable in the systems described above with reference to FIGS. 1-5. In particular, a first order treble boost (+9 dB) shelving filter (a) and a bass cut (−3 dB) shelving filter (b) are shown. Although the range of spectrum shaping functions is governed by the theory of linear filters, the adjustment of those functions and the flexibility with which they can be adjusted varies according to the topology of the circuitry and the requirements that have to be fulfilled.

Single shelving filters may be minimum phase (usually simple first-order) filters which alter the relative gains between frequencies much higher and much lower than the corner frequencies. A low or bass shelf is adjusted to affect the gain of lower frequencies while having no effect well above its corner frequency. A high or treble shelf adjusts the gain of higher frequencies only.

A single equalizer filter, on the other hand, implements a second-order filter function. This involves three adjustments: selection of the center frequency, adjustment of the quality (Q) factor, which determines the sharpness of the bandwidth, and the level or gain, which determines how much the selected center frequency is boosted or cut relative to frequencies (much) above or below the center frequency.

With other words: a low-shelf filter passes all frequencies, but increases or reduces frequencies below the shelf frequency by specified amount. A high-shelf filter passes all frequencies, but increases or reduces frequencies above the shelf frequency by specified amount. An equalizing (EQ) filter makes a peak or a dip in the frequency response.

Figure 8:
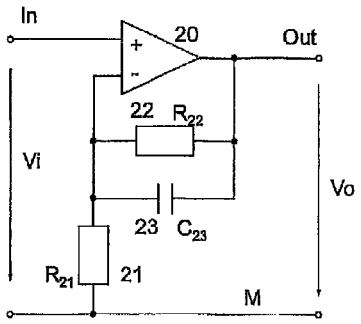
FIG. 8 is a block diagram illustrating the structure of an analog active 1st-order bass-boost shelving filter.

Reference is now made to FIG. 8 in which one optional filter structure of an analog active 1st-order bass-boost shelving filter is shown. The structure shown includes an operational amplifier 20 that includes an inverting input (−), a non-inverted input (+) and an output. A filter input signal In is supplied to the non-inverting input of operational amplifier 20 and at the output of the operational amplifier 20 a filter output signal Out is provided. The input signal In and the output signal Out are (in the present and all following examples) voltages Vi and Vo that are referred to a reference potential M. A passive filter (feedback) network including two resistors 21, 22 and a capacitor 23 is connected between the reference potential M, the inverting input of the operational amplifier 20 and the output of the operational amplifier 20 such that the resistor 22 and the capacitor 23 are connected in parallel with each other and together between the inverting input and the output of the operational amplifier 20. Furthermore, the resistor 21 is connected between the inverting input of operational amplifier 20 and the reference potential M.

The transfer characteristic H(s) over complex frequency s of the filter of FIG. 8 is:

$$H(s)=Z_o(s)/Z_i(s)=1+(R_{22}/R_{21})\cdot(1/(1+sC_{23}R_{22})),$$

in which $Z_i(s)$ is the input impedance of the filter, $Z_O(s)$ is the output impedance of the filter, $R_{21}$ is the resistance of the resistor 21, $R_{22}$ is the resistance of the resistor 22 and $C_{23}$ is the capacitance of the capacitor 23. The filter has a corner frequency $f_0$ in which $f_0=\frac{1}{2}\pi C_{23}R_{22}$. The gain $G_L$ at lower frequencies (≈0 Hz) is $G_L=1+(R_{22}/R_{21})$ and the gain $G_H$ at higher frequencies (≈∞Hz) is $G_H=1$. The gain $G_L$ and the corner frequency $f_0$ are determined, e.g., by the acoustic system used (loudspeaker-room-microphone system). For a certain corner frequency $f_0$ the resistances $R_{21}$, $R_{22}$ of the resistors 21 and 22 are:

$$R_{22}=\tfrac{1}{2}\pi f_0 C_{23}$$

$$R_{21}=R_{22}/(G_L-1).$$

As can been seen from the above two equations, there are three variables but only two equations so that it is an over-determined equation system. Accordingly, one variable has to be chosen by the filter designer depending on any further requirements or parameters, e.g., the mechanical size of the filter, which may depend on the mechanical size and, accordingly, on the capacity $C_{23}$ of the capacitor 23.

Figure 9:
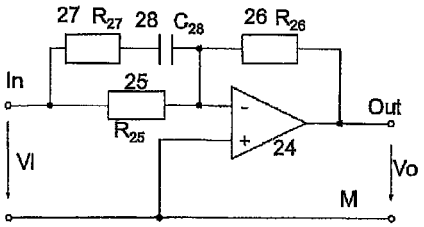
FIG. 9 is a block diagram illustrating the structure of an analog active 1st-order bass-cut shelving filter.

FIG. 9 illustrates an optional filter structure of an analog active 1st-order bass-cut shelving filter. The structure shown includes an operational amplifier 24 whose non-inverting input is connected to the reference potential M and whose inverting input is connected to a passive filter network. This passive filter network is supplied with the filter input signal In and the filter output signal Out, and includes three resistors 25, 26, 27 and a capacitor 28. The inverting input of the operational amplifier 24 is coupled through the resistor 25 to the input signal In and through the resistor 26 to the output signal Out. The resistor 27 and the capacitor 28 are connected in series with each other and as a whole in parallel with the resistor 25, i.e., the inverting input of the operational amplifier 24 is also coupled through the resistor 27 and the capacitor 28 to the input signal In.

The transfer characteristic H(s) of the filter of FIG. 9 is:

$$\begin{aligned} H(s) &= Z_o(s)/Z_i(s) \\ &= (R_{26}/R_{25})\cdot((1+sC_{28}(R_{25}+R_{27}))/(1+sC_{28}R_{27})) \end{aligned}$$

in which $R_{25}$ is the resistance of the resistor 25, $R_{26}$ is the resistance of the resistor 26, $R_{27}$ is the resistance of the resistor 27 and C28 is the capacitance of the capacitor 28. The filter has a corner frequency $f_0=\frac{1}{2}\pi C_{28}R_{27}$. The gain GL at lower frequencies (≈0 Hz) is $G_L=(R_{26}/R_{25})$ and the gain $G_H$ at higher frequencies (≈∞Hz) is $G_H=R_{26}\cdot(R_{25}+R_{27})/(R_{25}\cdot R_{27})$ which should be 1. The gain $G_L$ and the corner frequency $f_0$ are determined, e.g., by the acoustic system used (loudspeaker-room-microphone system). For a certain corner frequency $f_0$ the resistances $R_{25}$, $R_{27}$ of the resistors 25 and 27 are:

$$R_{25}=R_{26}/G_L$$

$$R_{27}=R_{26}/(G_H-G_L).$$

The capacitance of the capacitor 28 is as follows:

$$C_{28}=(G_H-G_L)/2\pi f_0 R_{26}.$$

Again, there is an over-determined equation system which, in the present case, has four variables but only three equations. Accordingly, one variable has to be chosen by the filter designer, e.g. the resistance $R_{26}$ of the resistor 26.

Figure 10:
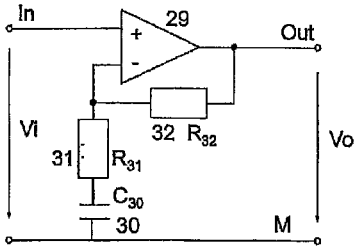
FIG. 10 is a block diagram illustrating the structure of an analog active 1st-order treble-boost shelving filter.

FIG. 10 illustrates an optional filter structure of an analog active 1st-order treble-boost shelving filter. The structure shown includes an operational amplifier 29 in which the filter input signal In is supplied to the non-inverting input of the operational amplifier 29. A passive filter (feedback) network including a capacitor 30 and two resistors 31, 32 is connected between the reference potential M, the inverting input of the operational amplifier 29 and the output of the operational amplifier 29 such that the resistor 32 and the capacitor 30 are connected in series with each other and together between the inverting input and the reference potential M. Furthermore, the resistor 31 is connected between the inverting input of the operational amplifier 29 and the output of the operational amplifier 29.

The transfer characteristic H(s) of the filter of FIG. 10 is:

$$H(s)=Z_o(s)/Z_i(s)=(1+sC_{30}(R_{31}+R_{32}))/(1+sC_{30}R_{31})$$

in which $C_{30}$ is the capacitance of the capacitor 30, $R_{31}$ is the resistance of the resistor 31 and $R_{32}$ is the resistance of the resistor 32. The filter has a corner frequency $f_0=\frac{1}{2}\pi C_{30}R_{31}$. The gain $G_L$ at lower frequencies (≈0 Hz) is $G_L=1$ and the gain $G_H$ at higher frequencies (≈∞Hz) is $G_H=1+(R_{32}/R_{31})$. The gain $G_H$ and the corner frequency $f_0$ are determined, e.g., by the acoustic system used (loudspeaker-room-microphone system). For a certain corner frequency $f_0$ the resistances $R_{31}$, $R_{32}$ of resistors 31 and 32 are:

$$R_{31}=\tfrac{1}{2}\pi f_{0\ C30}$$

$$R_{32}=R_{31}/(G_H-1)$$

Again, there is an over-determined equation system which, in the present case, has three variables but only two equations. Accordingly, one variable has to be chosen by the filter designer depending on any other requirements or parameters, e.g., the resistance $R_{32}$ of the resistor 32. This is advantageous because the resistor 32 should not be made too small in order to keep the share of the output current of the operational amplifier flowing through the resistor 32 low.

Figure 11:
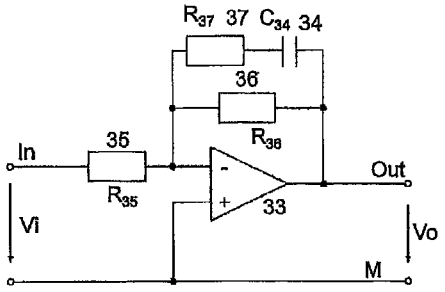
FIG. 11 is a block diagram illustrating the structure of an analog active 1st-order treble-cut shelving filter.

FIG. 11 illustrates an optional filter structure of an analog active 1st-order treble-cut shelving filter. The structure shown includes an operational amplifier 33 whose non-inverting input is connected to the reference potential M and whose inverting input is connected to a passive filter network. This passive filter network is supplied with the filter input signal In and the filter output signal Out, and includes a capacitor 34 and three resistors 35, 36, 37. The inverting input of the operational amplifier 33 is coupled through the resistor 35 to the input signal In and through the resistor 36 to the output signal Out. The resistor 37 and the capacitor 34 are connected in series with each other and as a whole in parallel with the resistor 36, i.e., inverting input of the operational amplifier 33 is also coupled through the resistor 37 and the capacitor 34 to the output signal Out.

The transfer characteristic H(s) of the filter of FIG. 11 is:

$$H(s) = Z_o(s)/Z_i(s)$$
$$= (R_{36}/R_{35})\cdot(1 + sC_{34}R_{37})/(1 + sC_{34}(R_{36} + R_{37}))$$

in which $C_{34}$ is the capacitance of the capacitor 34, $R_{35}$ is the resistance of the resistor 35, $R_{36}$ is the resistance of the resistor 36 and $R_{37}$ is the resistance of the resistor 37.

The filter has a corner frequency $f_0=\frac{1}{2}\pi C_{34}(R_{36}+R_{37})$. The gain $G_L$ at lower frequencies (≈0 Hz) is $G_L=(R_{36}/R_{35})$ and should be 1. The gain $G_H$ at higher frequencies (≈∞Hz) is $G_H=R_{36}\cdot R_{37}/(R_{35}\cdot(R_{36}+R_{37}))$. The gain $G_L$ and the corner frequency $f_0$ are determined, e.g., by the acoustic system used (loudspeaker-room-microphone system). For a certain corner frequency $f_0$ the resistances $R_{35}$, $R_{36}$, $R_{37}$ of the resistors 35, 36 and 37 are:

$$R_{35}=R_{36}$$

$$R_{37}=G_H\cdot R_{36}/(1-G_H).$$

The capacitance of the capacitor 34 is as follows:

$$C_{34}=(1-G_H)/2\pi f_0 R_{36}.$$

The resistor 36 should not be made too small in order to keep the share of the output current of the operational amplifier flowing through the resistor 36 low.

Figure 12:
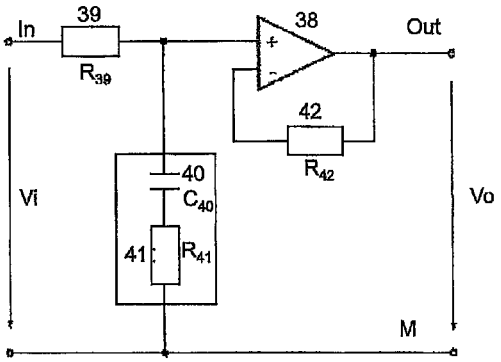
FIG. 12 is a block diagram illustrating the structure of an analog active 1st-order treble-cut shelving filter.

FIG. 12 illustrates an alternative filter structure of an analog active 1st-order treble-cut shelving filter. The structure shown includes an operational amplifier 38 in which the filter input signal In is supplied through a resistor 39 to the non-inverting input of the operational amplifier 38. A passive filter network including a capacitor 40 and a resistor 41 is connected between the reference potential M and the inverting input of the operational amplifier 38 such that the capacitor 30 and the resistor 41 are connected in series with each other and together between the inverting input and the reference potential M. Furthermore, a resistor 42 is connected between the inverting input and the output of the operational amplifier 38 for signal feedback.

The transfer characteristic H(s) of the filter of FIG. 12 is:

$$H(s)=Z_o(s)/Z_i(s)=(1+sC_{40}R_{41})/(1+sC_{40}(R_{39}+R_{41}))$$

in which $R_{39}$ is the resistance of the resistor 39, $C_{40}$ is the capacitance of the capacitor 40, $R_{41}$ is the resistance of the resistor 41 and $R_{42}$ is the resistance of the resistor 42. The filter has a corner frequency $f_0=\frac{1}{2}\pi C_{40}(R_{39}+R_{41})$. The gain $G_L$ at lower frequencies (≈0 Hz) is $G_L=1$ and the gain $G_H$ at higher frequencies (≈∞Hz) is $G_H=R_{41}/(R_{39}+R_{41})<1$. The gain $G_H$ and the corner frequency $f_0$ may be determined, e.g., by the acoustic system used (loudspeaker-room-microphone system). For a certain corner frequency $f_0$ the resistances $R_{39}$, $R_{41}$ of resistors the 39 and 41 are:

$$R_{39}=G_H R_{42}/(1-G_H)$$

$$R_{41}=(1-G_H)/2\pi f_0 R_{42}.$$

The resistor 42 should not be made too small in order to keep the share of the output current of the operational amplifier flowing through the resistor 42 low.

Figure 13:
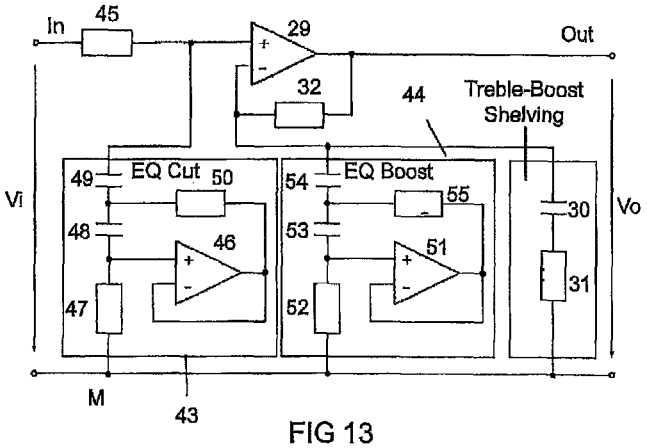
FIG. 13 is a block diagram illustrating an ANC filter including a shelving filter and additional equalizing filters.

FIG. 13 depicts an ANC filter that is based on the shelving filter structure described above in connection with FIG. 10 and that includes two additional equalizing filters 43, 44. The first equalizing filter 43 may be a cut equalizing filter for a first frequency band and the second equalizing filter 44 may be a boost equalizing filter for a second frequency band.

Equalization, in general, is the process of adjusting the balance between frequency bands within a signal.

The first equalizing filter 43 forms a gyrator and is circuit connected at one end to the reference potential M and at the other end to the non-inverting input of the operational amplifier 29, in which the input signal In is supplied to the non-inverting input through a resistor 45. The first equalizing filter 43 includes an operational amplifier 46 whose inverting input and its output are connected to each other. The non-inverting input of the operational amplifier 46 is coupled through a resistor 47 to reference potential M and through two series-connected capacitors 48, 49 to the non-inverting input of the operational amplifier 29. A tap between the two capacitors 48 and 49 is coupled through a resistor 50 to the output of the operational amplifier 46.

The second equalizing filter 44 forms a gyrator and is connected at one end to the reference potential M and at the other end to the inverting input of the operational amplifier 29, i.e., it is connected in parallel with the series connection of capacitor 30 and resistor 31. The second equalizing filter 44 includes an operational amplifier 51 whose inverting input and its output are connected to each other. The non-inverting input of the operational amplifier 46 is coupled through a resistor 52 to reference potential M and through two series-connected capacitors 53, 54 to the inverting input of the operational amplifier 29. A tap between the two capacitors 53 and 54 is coupled through a resistor 55 to the output of the operational amplifier 51.

A problem with ANC filters in mobile devices supplied with power from batteries is that the more operational amplifiers are used the higher the power consumption is. An increase in power consumption, however, requires larger and thus more space consuming batteries when the same operating time is desired, or decreases the operating time of the mobile device when using the same battery types. One approach to further decreasing the number of operational amplifiers may be to employ the operational amplifier for linear amplification only and to implement the filtering by passive networks connected downstream (or upstream) of the operational amplifier (or between two amplifiers). An exemplary structure of such an ANC filter structure is shown in FIG. 14.

Figure 14:
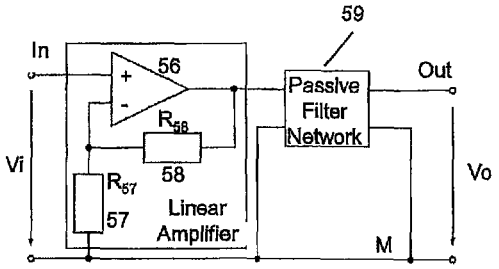
FIG. 14 is a block diagram illustrating an alternative ANC filter including a linear amplifier and a passive filter network.

In the ANC filter of FIG. 14, an operational amplifier 56 is supplied at its non-inverting input with the input signal In. A passive, non-filtering network including two resistors 57, 58 is connected to the reference potential M and the inverting input and the output of the operational amplifier 56 forming a linear amplifier together with the resistors 57 and 58. In particular, the resistor 57 is connected between the reference potential M and the inverting input of the operational amplifier 56 and resistor 57 is connected between the output and the inverting input of operational amplifier 56. A passive filtering network 59 is connected downstream of the operational amplifier, i.e., the input of the network 59 is connected to the output of the operational amplifier 56. A downstream connection is more advantageous than an upstream connection in view of the noise behavior of the ANC filter in total. Examples of passive filtering networks applicable in the ANC filter of FIG. 14 are illustrated below in connection with FIGS. 15-18.

Figure 15:
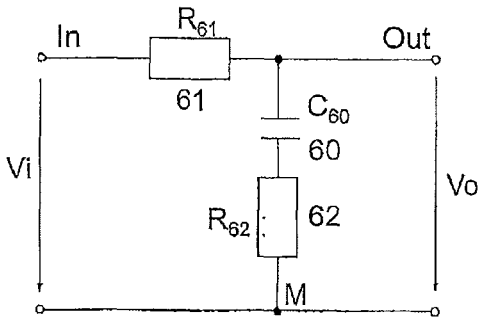
FIG. 15 is a block diagram illustrating the structure of an analog passive 1st-order bass (treble-cut) shelving filter.

FIG. 15 depicts a filter structure of an analog passive 1st-order bass (treble-cut) shelving filter, in which the filter input signal In is supplied through a resistor 61 to a node at which the output signal Out is provided. A series connection of a capacitor 60 and a resistor 62 is connected between the reference potential M and this node. The transfer characteristic H(s) of the filter of FIG. 15 is:

$$H(s)=Z_o(s)/Z_i(s)=(1+sC_{60}R_{62})/(1+sC_{60}(R_{61}+R_{62}))$$

in which $C_{60}$ is the capacitance of the capacitor 60, $R_{61}$ is the resistance of the resistor 61 and $R_{62}$ is the resistance of the resistor 62. The filter has a corner frequency $f_0=1/2\pi C_{40}(R_{61}+R_{62})$. The gain $G_L$ at lower frequencies (≈0 Hz) is $G_L=1$ and the gain $G_H$ at higher frequencies (≈∞Hz) is $G_H=R_{62}/(R_{61}+R_{62})$. For a certain corner frequency $f_0$ the resistances $R_{61}$, $R_{62}$ of the resistors 61 and 62 are:

$$R_{61}=(1-G_H)/2\pi f_0 C_{60},$$

$$R_{62}=G_H/2\pi f_0 C_{60}.$$

One variable has to be chosen by the filter designer, e.g., the capacitance $C_{60}$ of capacitor 60.

Figure 16:
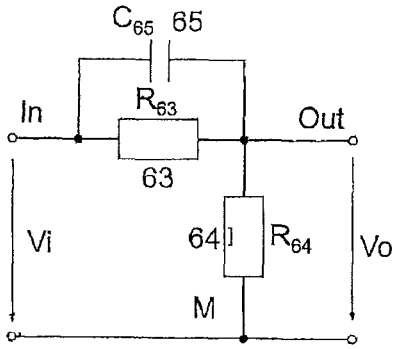
FIG. 16 is a block diagram illustrating the structure of an analog passive 1st-order treble (bass-cut) shelving filter.

FIG. 16 depicts an alternative filter structure of an analog passive 1st-order treble (bass-cut) shelving filter, in which the filter input signal In is supplied through a resistor 63 to a node at which the output signal Out is provided. A resistor 64 is connected between the reference potential M and this node. Furthermore, a capacitor 65 is connected in parallel with the resistor 63. The transfer characteristic H(s) of the filter of FIG. 16 is:

$$H(s)=Z_o(s)/Z_i(s)=R_{64}(1+sC_{65}R_{63})/(R_{63}+R_{64})+sC_{65}R_{63}R_{64})$$

in which $R_{63}$ is the resistance of the resistor 63, $R_{64}$ is the resistance of the resistor 64 and $C_{65}$ is the capacitance of the capacitor 65. The filter has a corner frequency $f_0=(R_{63}+R_{64})/(2\pi C_{65}R_{63}R_{64})$. The gain $G_H$ at higher frequencies (≈∞Hz) is $G_H=1$ and the gain $G_L$ at lower frequencies (≈0 Hz) is $G_L=R_{64}/(R_{63}+R_{64})$. For a certain corner frequency $f_0$ the resistances $R_{61}$, $R_{62}$ of resistors 61 and 62 are:

$$R_{63}=\tfrac{1}{2}\pi F_0 C_{65} G_L,$$

$$R_{64}=\tfrac{1}{2}\pi f_0 C_{65}(1-G_L).$$

Figure 17:
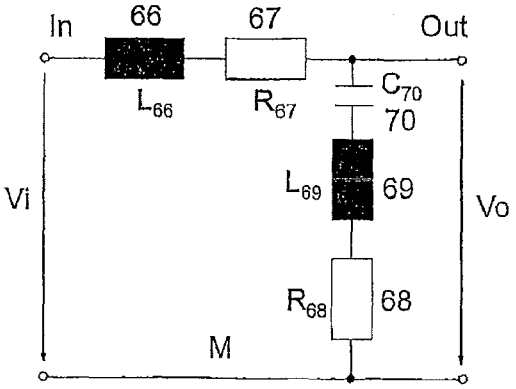
FIG. 17 is a block diagram illustrating the structure of an analog passive 2nd-order bass (treble-cut) shelving filter.

FIG. 17 depicts a filter structure of an analog passive 2nd-order bass (treble-cut) shelving filter, in which the filter input signal In is supplied through series connection of an inductor 66 and a resistor 67 to a node at which the output signal Out is provided. A series connection of a resistor 68, an inductor 69 and a capacitor 70 is connected between the reference potential M and this node. The transfer characteristic H(s) of the filter of FIG. 17 is:

$$\begin{aligned} H(s) &= Z_o(s)/Z_i(s) \\ &= (1+sC_{70}R_{68}+s^2C_{70}L_{69})/(1+sC_{70}(R_{67}+R_{68})+s^2C_{70}(L_{66}+L_{69})) \end{aligned}$$

in which $L_{66}$ is the inductance of the inductor 66, $R_{67}$ is the resistance of the resistor 67, $R_{68}$ is the resistance of the resistor 68, $L_{69}$ is the inductance of the inductor 69 and $C_{70}$ is the capacitance of the capacitor 70. The filter has a corner frequency $f_0=1/(2\pi(C_{70}(L_{66}+L_{69}))^{-1/2})$ and a quality factor $Q=(1/(R_{67}+R_{68}))\cdot((L_{66}+L_{69})/C_{70})^{-1/2})$. The gain $G_L$ at lower frequencies (≈0 Hz) is $G_L=1$ and the gain $G_H$ at higher frequencies (≈∞Hz) is $G_H=L_{69}/(L_{66}+L_{69})$. For a certain corner frequency $f_0$ resistance $R_{67}$, capacitance $C_{70}$ and inductance $L_{69}$ are:

$$L_{69}=(G_H L_{66})/(1-G_H),$$

$$C_{70}=(1-G_H)/((2\pi f_0)^2 L_{66}), \text{ and}$$

$$R_{68}=((L_{66}+L_{69})/C_{70})^{-1/2}-r_{67}Q)/Q.$$

Figure 18:
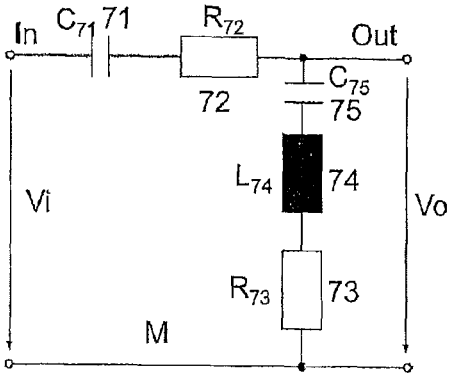
FIG. 18 is a block diagram illustrating the structure of an analog passive 2nd-order treble (bass-cut) shelving filter.

FIG. 18 depicts a filter structure of an analog passive 2nd-order treble (bass-cut) shelving filter, in which the filter input signal In is supplied through series connection of an capacitor 71 and a resistor 72 to a node at which the output signal Out is provided. A series connection of a resistor 73, an inductor 74 and a capacitor 75 is connected between the reference potential M and this node. The transfer characteristic H(s) of the filter of FIG. 18 is:

$$H(s) = Z_o(s)/Z_i(s)$$

$$= C_{71}(1 + sC_{75}R_{73} + s^2C_{75}L_{74})/((C_{71} + C_{75}) + sC_{71}C_{75}(R_{72} + R_{73}) + s^2C_{71}C_{75}L_{74})$$

in which $C_{71}$ is the capacitance of the capacitor 71, $R_{72}$ is the resistance of the resistor 72, $R_{73}$ is the resistance of the resistor 73, $L_{74}$ is the inductance of the inductor 74 and $C_{75}$ is the capacitance of the capacitor 75. The filter has a corner frequency $f_0=((C_{71}+C_{75})/(4\pi^2(L_{74}C_{71}C_{75}))^{-1/2}$ and a quality factor $Q=(1/(R_{72}+R_{73}))\cdot((C_{71}C_{75})L_{74}/(C_{71}C_{75}))^{-1/2}$. The gain $G_H$ at higher frequencies ($\approx\infty$Hz) is $G_H=1$ and the gain $G_L$ at lower frequencies ($\approx$0 Hz) is $G_L=C_{71}/(C_{71}+C_{75})$. For a certain corner frequency $f_0$ resistance $R_{73}$, capacitance $C_{75}$ and inductance $L_{74}$ are:

$$C_{75}=(1-G_L)C_{71}/G_L,$$

$$L_{74}=1/((2\pi f_0)^2C_{71}(1-G_L)), \text{ and}$$

$$R_{73}=((L_{74}/(C_{70}(1-G_L)))^{-1/2}/Q)-R_{72}.$$

All inductors used in the examples above may be substituted by an adequately configured gyrator.

Figure 19:
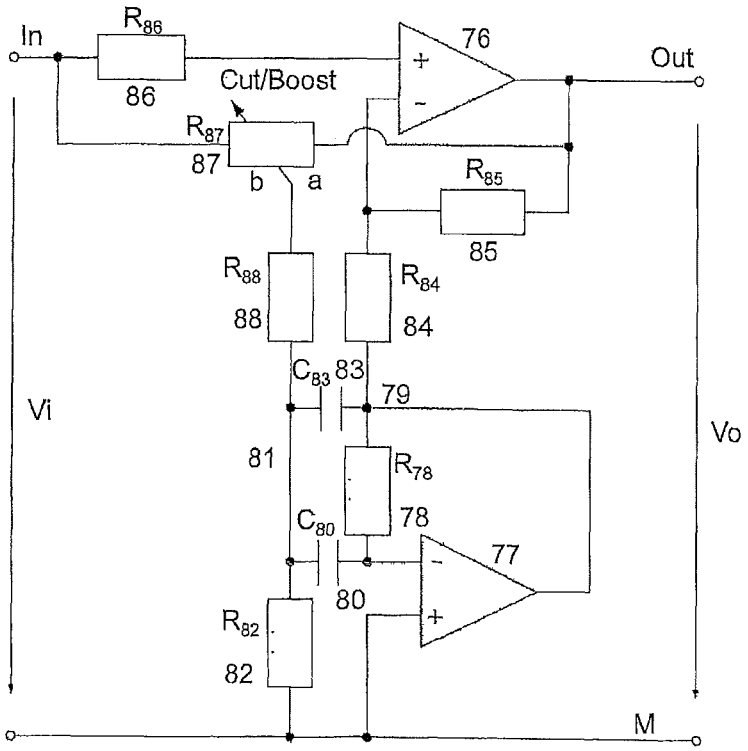
FIG. 19 is a block diagram illustrating a universal ANC filter structure that is adjustable in terms of, boost or cut equalizing filter with high quality and/or low gain.

With reference to FIG. 19, a universal ANC filter structure is described that is adjustable in terms of boost or cut equalizing. The filter includes an operational amplifier 76 as linear amplifier and a modified gyrator circuit. In particular, the universal ANC filter structure includes another operational amplifier 77, the non-inverting input of which is connected to reference potential M. The inverting input of the operational amplifier 77 is coupled through a resistor 78 to a first node 79 and through a capacitor 80 to a second node 81. The second node 81 is coupled through a resistor 82 to the reference potential M, and through a capacitor 83 with the first node 79. The first node 79 is coupled through a resistor 84 to the inverting input of the operational amplifier 76, its inverting input is further coupled to its output through a resistor 85. The non-inverting input of operational amplifier 76 is supplied through a resistor 86 with the input signal In. A potentiometer 87 forming an adjustable Ohmic voltage divider with two partial resistors 87*a* and 87*b* and having two ends and an adjustable tap is supplied at each end with input signal In and the output signal Out. The tap is coupled through a resistor 88 to the second node 81.

The transfer characteristic H(s) of the filter of FIG. 19 is:

$$H(s)=(b_0+b_1s+b_2s^2)/(a_0+a_1s+a_2s)$$

in which $$b_0=R_{84}R_{87a}R_{88}+R_{87b}R_{88}R+R_{87a}R_{88}R+R_{84}R_{87b}R_{88}+R_{84}R_{87a}R_{82}+R_{84}R_{87a}R_{87b}+R_{87a}R_{87b}R+RR_{87b}R_{82}+R_{87a}R_{82},$$

$$b1=R_{87a}C_{80}R_{82}RR_{88}+RC_{83}R_{88}R_{82}R_{87b}+R_{84}R_{87b}R_{88}C_{83}R_{82}+R_{87a}C_{83}R_{82}RR_{88}+R_{84}R_{87a}R_{88}C_{83}R_{82}+R_{84}R_{87a}R_{87b}C_{80}R_{82}+R_{84}R_{87a}R_{88}C_{80}R_{82}+R_{84}R_{87b}R_{88}C_{80}R_{82}+R_{87a}C_{80}R_{82}RR_{87b}+C_{80}R_{82}R_{78}RR_{87b}+RC_{80}R_{88}R_{82}R_{87b}+R_{84}R_{87a}R_{87b}C_{83}R_{82}+R_{87a}C_{83}R_{82}RR_{87b},$$

$$b_2=R_{87a}R_{82}R_{88}RC_{80}C_{83}R_{78}+RR_{87b}R_{88}C_{80}C_{83}R_{82}R_{78}+R_{84}R_{87b}R_{88}C_{80}C_{83}R_{82}R_{78}+R_{84}R_{87a}R_{88}C_{80}C_{83}R_{82}R_{78}+R_{84}R_{87a}R_{87b}C_{80}C_{83}R_{82}R_{78}+RR_{87a}R_{87b}C_{80}C83R_{82}R_{78}.$$

$$a_0=R_{84}R_{87b}R_{82}+R_{84}R_{87a}R_{82}+R_{84}R_{87b}R_{88}+R_{84}R_{87a}R_{88}+R_{84}R_{87a}R_{87b},$$

$$a_1=R_{84}R_{87b}R_{88}C_{80}R_{82}+R_{84}R_{87b}R_{88}C_{83}R_{82}+R_{84}R_{87a}R_{88}C_{83}R_{82}+R_{84}R_{87a}R_{88}C_{80}R_{82}+R_{84}R_{87a}R_{87b}C_{83}R_{82}+R_{84}R_{87a}R_{87b}C_{80}R_{82}-R_{87a}R_{82}C_{80}RR_{78},$$

$$a_2=R_{84}R_{87b}R_{88}C_{80}C_{83}R_{82}R_{78}+R_{84}R_{87a}R_{88}C_{80}C_{83}R_{82}R_{78}+R_{84}R_{87a}R_{87b}C_{80}C_{83}R_{82}R_{78}.$$

in which a resistor X has a resistance Rx (X=78, 82, 84, 85, 86, 87a, 87b, 88), a capacitor Y (Y=80, 83) has a capacitance Cy and $R_{85}=R_{86}=R$.

Shelving filters in general and 2nd-order shelving filters in particular require careful design when applied to ANC filters, but offer a lot of benefits such as, e.g., minimum phase properties as well as little space and energy consumption.

Although various examples of realizing the invention have been disclosed, it will be apparent to those skilled in the art that various changes and modifications can be made which will achieve some of the advantages of the invention without departing from the spirit and scope of the invention. It will be obvious to those reasonably skilled in the art that other components performing the same functions may be suitably substituted. Such modifications to the inventive concept are intended to be covered by the appended claims.

Although the present invention has been illustrated and described with respect to several preferred embodiments thereof, various changes, omissions and additions to the form and detail thereof, may be made therein, without departing from the spirit and scope of the invention.

What is claimed is:

1. A noise reducing system comprising:

a loudspeaker that is connected to a loudspeaker input path and receives a loudspeaker input signal, and that radiates noise reducing sound;

a microphone that is connected to a microphone output path and that picks up the noise or a residual thereof and provides a sensed signal indicator thereof; and an active noise reduction filter that is connected between the microphone output path and the loudspeaker input path; wherein the active noise reduction filter comprises at least one equalizing filter, wherein the equalizing filter comprises a first linear amplifier and at least one passive filter network.

2. The system of claim 1, in which the equalizing filter is selected from one of an active or passive analog filter.

3. The system of claim 1, wherein the equalizing filter has at least a 2nd order filter structure.

4. The system of claim 1, wherein the passive filter network forms a feedback path of the first linear amplifier.

5. The system of claim 4, wherein a passive filter network is connected in series with the first linear amplifier.

6. The system of claim 1, wherein the active noise reduction filter comprises a gyrator.

7. The system of one of claim 1, wherein:

the active noise reduction filter comprises first and second operational amplifiers having an inverting input, a non-inverting input and an output;

the non-inverting input of the first operational amplifier is connected to a reference potential;

the inverting input of the first operational amplifier is coupled through a first resistor to a first node and through a first capacitor to a second node;

the second node is coupled through a second resistor to the reference potential and through a second capacitor with the first node;

the first node is coupled through a third resistor to the inverting input of the second operational amplifier, its inverting input is further coupled to its output through a fourth resistor;

the second operational amplifier is supplied with an input signal In at its non-inverting input and provides and output signal at its output; and an Ohmic voltage divider having two ends and a tap is supplied at each end with the input signal In and the output signal Out, the tap being coupled through a fifth resistor to the second node.

8. The system of claim 7, wherein the input signal is supplied to the non-inverting input of the second operational amplifier through a sixth resistor.

9. The system of claim 7, wherein the Ohmic voltage divider is an adjustable potentiometer.

10. The system of claim 9, wherein a useful signal is supplied to the loudspeaker input path or the microphone output path or both.

11. The system of claim 10, wherein the useful signal is supplied through a first and second useful-signal path to both the loudspeaker input path and the microphone output path such that:

a first subtractor is connected downstream of the microphone output path and the first useful-signal path; and a second subtractor is connected between the active noise reduction filter and the loudspeaker input path and to the second useful-signal path.

12. The system of claim 11, wherein at least one of the first and second useful-signal paths comprise one or more spectrum shaping filters.

13. The system of claim 12, wherein the microphone is acoustically coupled to the loudspeaker via a secondary path.

14. The system of claim 1, further comprising:

a first summer that receives a filtered signal from the active noise reduction filter and a useful signal and provides the loudspeaker input signal as a difference thereof; and a second summer that receives the sensed signal indicator and the useful signal and provides an ANC input signal indicative of a difference thereof.

15. A noise reducing system comprising:

a loudspeaker that receives an input signal and radiates an audio signal indicative thereof;

a microphone that senses audio that includes a disturbing signal and provides a sensed signal indicative of;

an active noise reduction filter that receives an ANC input signal indicative of the sensed signal and provides a filtered signal, wherein the active noise reduction filter comprises an equalizing filter;

a first summer that receives the filtered signal and a useful signal and provides the input signal as a difference thereof; and a second summer that receives the sensed signal and the useful signal and provides the ANC input signal indicative of the difference thereof.

16. A noise reducing system comprising:

a loudspeaker that is connected to a loudspeaker input path and receives a loudspeaker input signal, and that radiates noise reducing sound;

a microphone that is connected to a microphone output path and that picks up the noise or a residual thereof and provides a sensed signal indicator thereof;

an active noise reduction filter that is connected between the microphone output path and the loudspeaker input path; wherein the active noise reduction filter comprises at least one equalizing filter;

a first summer that receives a filtered signal from the active noise reduction filter and a useful signal and provides the loudspeaker input signal as a difference thereof; and a second summer that receives the sensed signal indicator and the useful signal and provides an ANC input signal indicative of a difference thereof.

* * * * *